United States Patent [19]

Nutting

[11] Patent Number: 4,973,056

[45] Date of Patent: Nov. 27, 1990

[54] SIMULATED BASKETBALL GAME

[76] Inventor: David J. Nutting, 20 Pine Pl. Log Hill Village, Ridgway, Colo. 81432

[21] Appl. No.: 356,120

[22] Filed: May 24, 1989

[51] Int. Cl.[5] ..... A63F 7/06

[52] U.S. Cl. ..... 273/85 C; 273/85 E; 273/85 F; 273/85 H; 273/119 B; 273/129 S; 273/340

[58] Field of Search ..... 273/85 R, 85 A–85 F, 273/85 H, 340, 129 AP, 129 S–129 W, 119 B, 119 R; 124/63, 64

[56] References Cited

U.S. PATENT DOCUMENTS

| | | | |
|---|---|---|---|
| 943,472 | 12/1909 | Schreiber et al. | 273/85 H |
| 1,703,240 | 2/1929 | Jacobson | 273/94 |
| 1,713,247 | 5/1929 | Young | 273/85 C |
| 1,827,885 | 10/1931 | Emenhiser | 273/85 E |
| 1,915,452 | 6/1933 | Sheffler et al. | 273/85 E |
| 1,917,700 | 7/1933 | Clark | 273/85 E |
| 2,431,552 | 11/1947 | Gosnell | 273/85 F |
| 2,433,224 | 12/1947 | Koci et al. | 273/85 F |
| 2,799,501 | 7/1957 | Barbolla | 273/85 D |
| 3,074,720 | 1/1963 | Carver et al. | 273/85 F |
| 3,592,470 | 7/1971 | Breslow | 273/85 E |
| 3,741,541 | 6/1973 | Crismani | 273/85 H |
| 3,781,010 | 12/1973 | Matsumoto | 273/85 C |
| 3,901,508 | 8/1975 | Spangler | 273/85 E |
| 4,009,881 | 3/1977 | Potter, III | 273/85 E |
| 4,239,218 | 12/1980 | Kreuzer | 273/85 E |

FOREIGN PATENT DOCUMENTS

| | | | |
|---|---|---|---|
| 827765 | 1/1952 | Fed. Rep. of Germany | 273/85 R |
| 170977 | 4/1952 | Fed. Rep. of Germany . | |
| 951911 | 11/1949 | France | 273/85 E |
| 981020 | 5/1951 | France | 273/85 E |
| 2358908 | 3/1978 | France | 273/85 H |
| 504480 | 12/1954 | Italy | 273/85 R |
| 272624 | 7/1927 | United Kingdom . | |
| 1404264 | 8/1975 | United Kingdom | 273/85 E |
| 2018607 | 10/1979 | United Kingdom | 273/85 H |
| 2063081 | 6/1981 | United Kingdom | 273/85 H |

OTHER PUBLICATIONS

"Pro-League Action Basketball", as Seen in *Sears Christmas Catalog,* 1967, p. 460.

"Pro-League Deluxe Large Basketball Game", as Advertized by Sales Brochure for Gotham Steel Corporation (GPS), 1970.

*Primary Examiner*—Edward M. Coven
*Assistant Examiner*—Sebastiano Passaniti
*Attorney, Agent, or Firm*—Welsh & Katz, Ltd.

[57] ABSTRACT

A simulated basketball game includes a play surface having baskets at its opposite ends and defining a plurality of ball shooting-position openings each of which overlies a ball propelling paddle. The ball propelling paddles are selectively interconnected so that each player controls a plurality of paddles through a single player controlled fluid pressure cylinder in an offensive mode of play. Each player also controls a defensive player-figure which requires relatively precise timed actuation in order to block an opponent's shot.

21 Claims, 3 Drawing Sheets

SIMULATED BASKETBALL GAME

BACKGROUND OF THE INVENTION

The present invention relates generally to game devices, and more particularly to a novel simulated basketball game adapted to be played by two players each of whom controls offensive ball propelling means and a defensive player-figure selectively operable to block the opponent's shots.

Game devices are generally known which simulate the game of basketball and which enable two or more players to selectively mechanically propel a simulated basketball toward a selected one of two baskets supported at opposite ends of a play surface. See, for example, U.S. Pat. Nos. 943,472, 1,116,593, 1,827,885, 2,522,782, 3,781,010, 3,811,674, 3,901,508 and 4,239,218. A variation or alternative basketball type game employs what is generally termed a half-court playing surface and includes a defensive player-figure which is operable to attempt blocking of an opponent's shot. See, for example, U.S. Pat. Nos. 2,431,552, 2,433,224, and 3,592,470.

A significant drawback in the prior simulated basketball games which employ a basket at each end of a play surface is that while the player opponents can each play an offensive game, they cannot inhibit play of the opponent through defensive maneuvers. Another disadvantage lies in the rather complex mechanisms employed for propelling ball toward opponent's basket or, in the case of half-court games, the mechanisms employed to actuate a defensive player-figure to attempt blocking of an opponent's shot. For the most part, where the prior game devices employ play surfaces defining a plurality of positions from which a game ball may be propelled or shot toward an opponent's basket, the player must quickly shift or transfer his hands between various ball propelling controls. Another drawback in the half-court games is that the defensive player-figures may be maintained in defensive or blocking positions for indefinite periods, thus reducing the skill level required by eliminating the need to precisely coordinate actuation of a defensive player-figure to a blocking position with the opponent's shot.

SUMMARY OF THE INVENTION

One of the primary objects of the present invention is to provide a novel simulated basketball game which is relatively simple in operation but which enables each of two player opponents to effect both offensive and defensive maneuvers, and thereby calls for a more challenging skill level than prior simulated basketball games.

A more particular object of the present invention is to provide a novel simulated basketball game device having ball propelling paddles operable through player controlled fluid pressure cylinders, and having player controlled defensive player-figures adjacent opposite ends of the play surface which require relatively precise timed actuation in order to block an opponent's shot.

A further object of the present invention is to provide a novel simulated basketball game including a play surface having a plurality of openings each of which defines a shooting position and is surrounded by a surface area or zone configured to cause a game ball disposed thereon to migrate toward the corresponding opening. A basket is supported at each end of the play surface and a ball propelling paddle is supported below each opening such that selected ones of the paddles are controlled by each of two players to enable shooting of the game ball toward the opponent's basket. Each player also controls a defensive player-figure supported adjacent the player's basket for attempted blocking of the opponent's shots.

A feature of the simulated basketball game in accordance with the invention lies in the provision of a novel fluid pressure actuating arrangement wherein each player may simultaneously actuate his corresponding ball propelling paddles so as to effect controlled impact engagement with the game ball, and also control a defensive player-figure requiring generally precise actuation in order to block an opponent's shot.

Another feature of the present simulated basketball game lies in the ability of each player to control the impact force imparted to the game ball from each shooting position in proportion to player actuation of a corresponding air pump to thereby control the trajectory of the ball toward the opponent's basket.

Another feature of the simulated basketball game of the invention lies in the provision of defensive player-figures having pivotal arms which are biased to downward non-blocking positions by gravity and which are movable to upward ball-blocking positions through player actuation of the player-figures. Upon reaching their upward ball-blocking positions, the arms begin immediate descent to their non-blocking positions outside the control of the corresponding player, thus requiring relatively precise actuation in order to block an opponent's shot.

Further objects, features and advantages of the invention, together with its organization and manner of operation, will become apparent from the following detailed description when taken in conjunction with the accompanying drawings wherein like reference numerals designate like elements throughout the several views.

DETAILED DESCRIPTION

Figure 1:
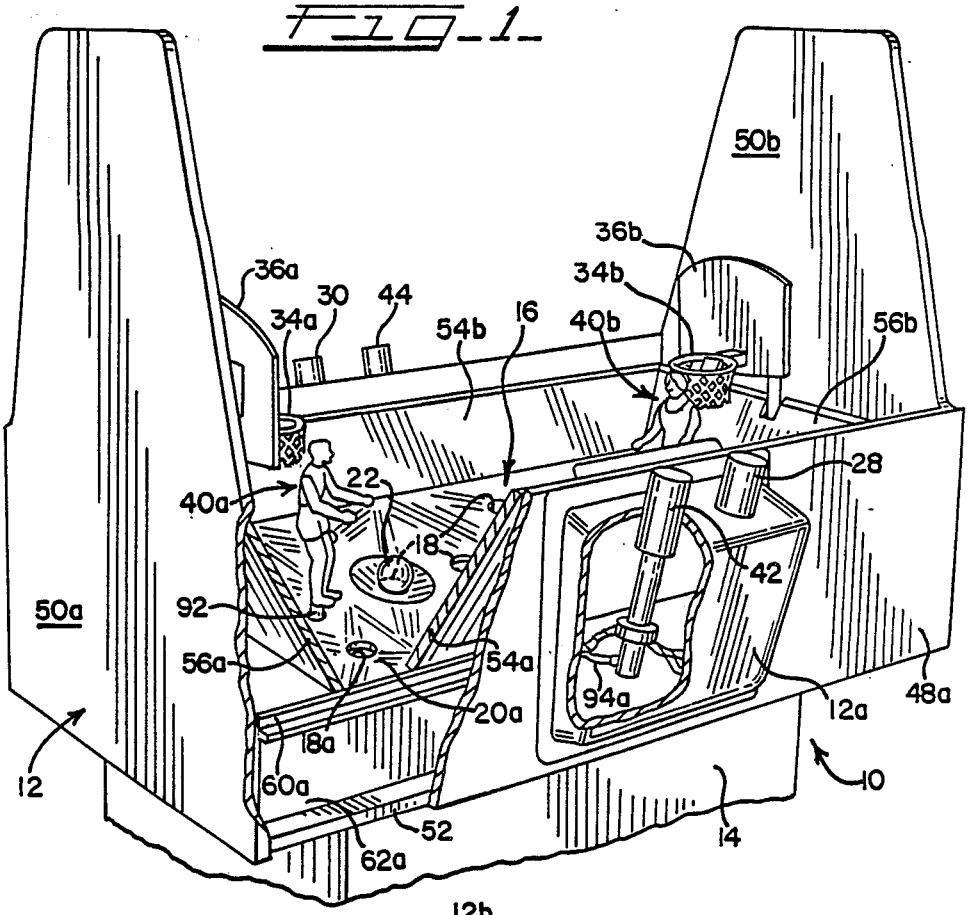
FIG. 1 is a perspective view of a simulated basketball game constructed in accordance with the present invention, portions being broken away for purposes of clarity.

Referring now to the drawings, a simulated basketball game constructed in accordance with one embodiment of the present invention is indicated at 10 in FIG. 1. Very generally, the basketball game 10 includes a rectangular cabinet or housing 12 which is preferably supported at waist height on a base support or pedestal 14. A gameboard or play surface 16 is supported within the housing and has a plurality of openings 18 formed therein each of which defines a ball shooting position and is surrounded by an inclined surface area or zone, such as indicated at 20*a* in FIG. 1 surrounding an opening 18*a*, configured to cause a spherical game ball 22 disposed on an inclined surface to migrate by gravity to the corresponding opening 18. The openings 18 are made smaller in diameter than the ball 22. The various inclined surface areas or zones are contiguous so that the game ball will always roll to a ball-shooting position when on the play surface.

Figure 2:
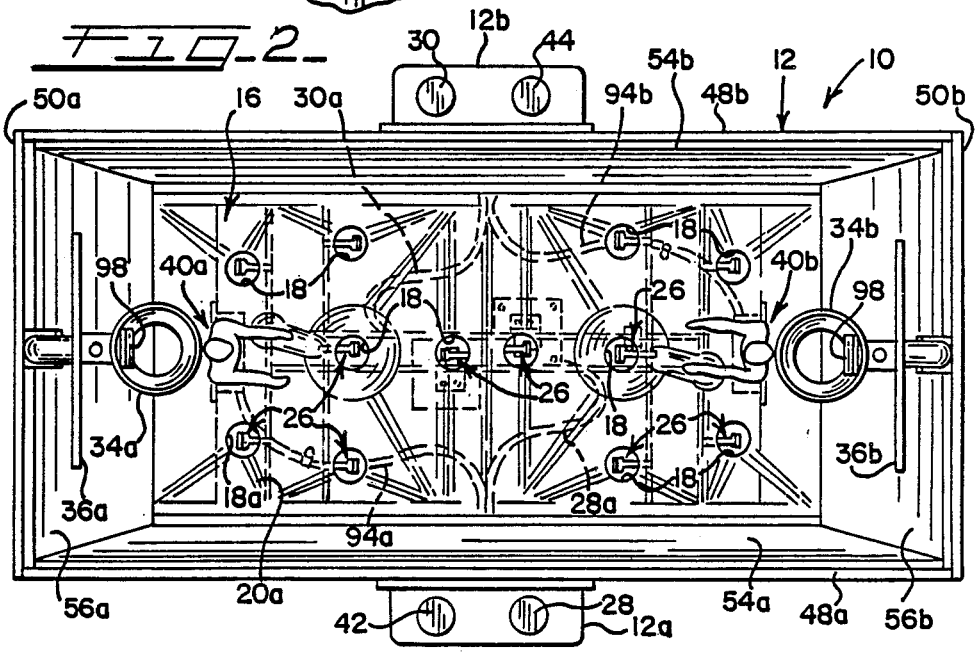
FIG. 2 is a plan view of the simulated basketball game of FIG. 1 but with the play surface shown as being transparent to show the underlying operating mechanism.

As shown in FIG. 2, a ball propelling paddle or shooter member 26 is supported below each opening 18, with selected ones of the paddles being controlled by each of two player opponents, although more than two players may play the game. The paddles may be selectively actuated by the players through control means in the form of conventional manually operated air pump cylinders 28 and 30 mounted on opposite sides of the housing 12 for easy access by the players when standing on opposite sides of the housing or cabinet.

A pair of simulated baskets or hoops 34*a* and 34*b* and associated simulated backboards 36*a* and 36*b*, respectively, are supported at opposite ends of the play surface 16 in spaced relation above the play surface. The paddles 26 associated with each player's ball-shooting position openings 18 are adapted to propel a ball located within the corresponding opening toward the opponent's basket in an arcuate trajectory. A pair of defensive player-figures 40*a* and 40*b* are supported adjacent the baskets 34*a* and 34*b*, respectively, and each is operable by one of the players to attempt blocking of an opponent's shot from the play surface. In the illustrated embodiment, each player-figures 40*a,b* is operable through actuating means in the form of a second manually operated air pump cylinder, indicated at 42 and 44, respectively, supported generally adjacent the player's corresponding paddle control air pump cylinder 28 or 30. As will be more fully described, the defensive player-figures may be selectively actuated by alternative actuating means. Scoring may be calculated in similar fashion to a conventional basketball game, or in accordance with any scoring scheme devised by the player opponents.

Turning now to a more detailed description of the simulated basketball game 10, the housing 12 includes a pair of parallel upstanding sidewalls 48*a* and 48*b* which are affixed at their opposite ends to the lateral edges of upstanding end walls 50*a* and 50*b*. The end walls extend above the upper edges of the sidewalls to provide support for a removable transparent plastic cover or dome (not shown) which may be employed to maintain the game ball in play without inhibiting visual observation of the ball and various game components during play. A rectangular base plate 52 has its peripheral marginal edges secured to the lower inside surfaces of the sidewalls 48*a,b* and end walls 50*a,b* and may be affixed to the upper end of the base support 14. If desired, inclined side and end panels, indicated at 54*a,b* and 56*a,b*, respectively, may be supported within the housing 12 to extend from the play surface 16 upwardly a distance corresponding generally to the upper edges of the sidewalls, as shown in FIG. 1.

As illustrated in FIG. 2, the gameboard or play surface 16 is symmetrical about both its major longitudinal axis and its minor transverse axis. The play surface is shown as being transparent to better reveal the underlying paddle actuating mechanism, but preferably has the various inclined surface areas or zones surrounding the openings 18 selectively colored to better identify the surface areas and associated ball shooting positions 18 controlled by each player during play. The inclined play surface peripherally of each opening 18 may be of generally frusto-conical or dish-shaped configuration, or a combination of downwardly inclined planar and curved surfaces, so as to cause a game ball located on the play surface to roll to the opening 18 corresponding to the inclined surface on which the ball is disposed. In the illustrated embodiment, six openings or shooting positions 18 are formed in each half-court of the play surface 16 with each half-court area having a single opening 18 located generally on the longitudinal axis proximate the transverse center axis, a pair of openings located on opposite sides of each defensive player-figure and generally aligned transversely therewith, and three openings located in transverse alignment generally intermediate the longitudinal length of the corresponding half-court area.

Figure 3:
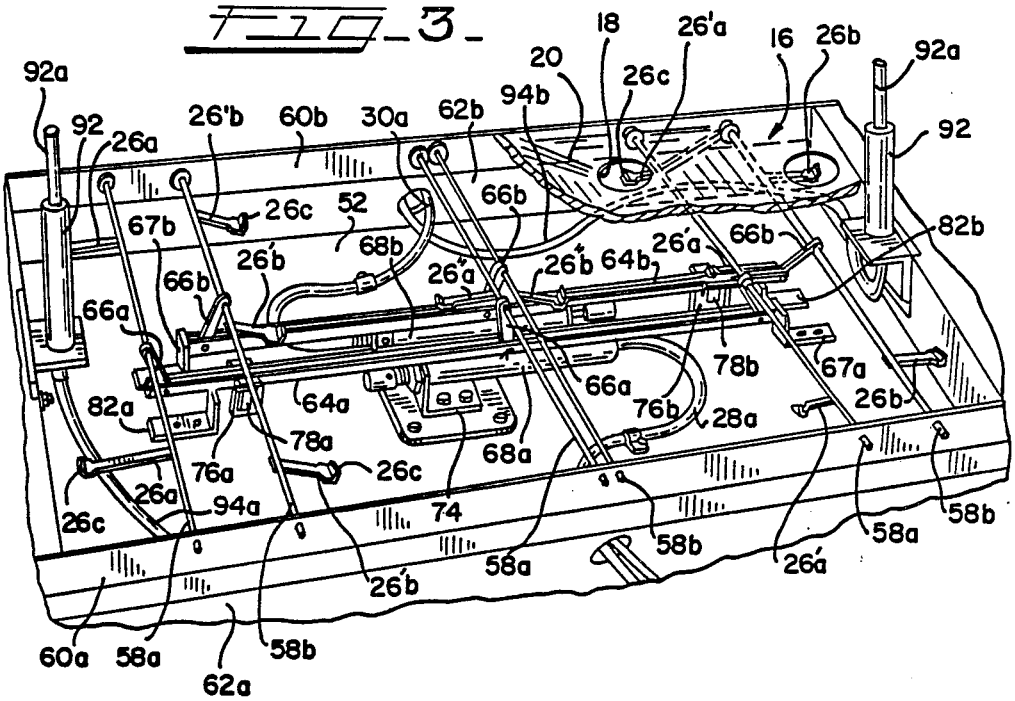
FIG. 3 is a fragmentary perspective view illustrating the support and actuating mechanism for the ball propelling paddles and the defensive player-figures.

As aforementioned, the ball propelling paddles or shooter members 26 are adapted to be selectively actuated by the player opponents so as to enable each player to propel the game ball 22, which may comprise a conventional ping-pong ball, from selected ones of the shooting positions 18 toward the opponent player's basket 34*a* or 34*b*. Referring to FIG. 3, taken in conjunction with FIG. 2, a plurality of transverse paddle support rods 58*a* and 58*b* have their opposite ends received through and rotatably supported by elongated L-shaped support members 60*a* and 60*b* which are mounted on the base plate 52 through support blocks 62*a* and 62*b* such that the paddle support rods lie in a common plane parallel to and spaced above the base plate. The support members 60*a,b* also support the contoured gameboard or play surface 16 which may be formed of a suitable plastic having downwardly turned longitudinal marginal edges received over the support members 60*a,b* such that the play surface is generally parallel to the base plate and overlies the paddle support rods. Each of the paddle support rods 58*a* and 58*b* is located proximate a selected transverse row of openings 18 in the play surface 16. In the embodiment illustrated in FIG. 3, three paddle support rods 58*a* are controlled by one of the players, and three paddle support rods 58*b* are controlled by the other player. The paddle support rods 58*a* are interconnected for simultaneous equal angular rotation about their longitudinal axes by a longitudinally extending connector bar or channel 64*a* which is pivotally connected to the paddle support rods 58*a* through equal length radial arms 66*a* fixed in normal relation to the rods 58*a*. The paddle support rods 58*b* are similarly interconnected for simultaneous equal angular rotation about their longitudinal axes through a longitudinal connector bar 64*b* and equal length radial arms 66*b* fixed to the rods 58*b*. In this manner, longitudinal movement of the connector bars 64*a* and 64*b* effects simultaneous substantially equal rotation of the corresponding paddle support rods 58*a* and 58*b*.

Each of the paddle support rods 58*a* and 58*b* supports a number of ball propelling paddles 26 corresponding to the number of ball-shooting position openings 18 controlled by the particular paddle support rod. Thus, as shown in FIG. 3, each of the paddle support rods 58*a* and 58*b* at the opposite ends of the play surface has a pair of ball propelling paddles, indicated at 26*a* and 26*b*, respectively, fixed in radial relation thereon. In similar fashion, each of the paddle support rods 58*a* and 58*b* which corresponds to a row of three transversely aligned openings 18 has three radial ball propelling paddles 26'*a* and 26'*b*, respectively, fixed thereon. The remaining two paddle support rods 58*a* and 58*b* are supported generally adjacent the transverse center of the play surface and each carries a single radial ball propelling paddle 26''*a* and 26''*b*, respectively.

Figure 6:
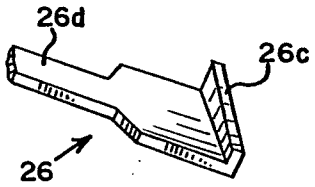
FIG. 6 is a fragmentary perspective view, on an enlarged scale, of a ball propelling paddle.

Each of the ball propelling paddles 26 has a generally L-shaped ball impacting outer end 26*c* which is sized and positioned to project upwardly within the corresponding ball opening 18 upon selective rotation of the corresponding paddle support rod. The ball impacting ends 26*c* of the paddles are configured to impact the game ball when disposed within the corresponding opening 18 so as to propel the ball toward the opponents basket 34*a* or 34*b*. For example, the upper ball engaging edges 26*c* of the paddles are selectively inclined or canted relative to horizontal so that the paddles 26*a*, 26'*a* and 26''*a* are operative to propel the game ball toward the basket 34*b*, and the paddles 26*b*, 26'*b* and 26''*b* are operative to propel the game ball toward basket 34*a*. FIG. 6 illustrates a ball impacting outer end 26*c* of a paddle 26 which is generally typical of the paddles spaced laterally from the longitudinal center of the play surface. The ball engaging edge 26*c* is inclined or canted relative to horizontal so as to impart a force to the game ball on impact which propels the ball toward its corresponding target basket. It will be understood that the angle of incline or cant will vary for each paddle so as to effect a proper trajectory for the game ball from each shooting position. The ball propelling paddles are preferably made of varying radial lengths such that the paddles which effect the longest shots, i.e. the paddles farthest from their corresponding target basket, are made of longer radial length than the paddles closer to their target basket. This allows the ball impacting ends 26*c* of the paddles farthest from their target basket to be caused by a player to undergo greater tangential velocity and thereby impart greater impact energy to the game ball to propel it towards its target basket than may be obtained for shorter distance shots.

The ball propelling paddles 26, radial pivot arms 66*a,b* and associated connector bars 64*a,b* are preferably configured and balanced so that the paddles are normally urged by gravity to lowered or retracted positions as shown in FIG. 3. To ensure that the paddles do not retract or rotate downwardly below their desired predetermined balanced positions shown in FIG. 3, a pair of L-shaped stops 67*a* and 67*b* are mounted on the base 52 so that each stop limits movement of the corresponding connector bar 64*a* or 64*b* in a direction which would allow greater downward rotation of the associated paddles.

Figure 4:
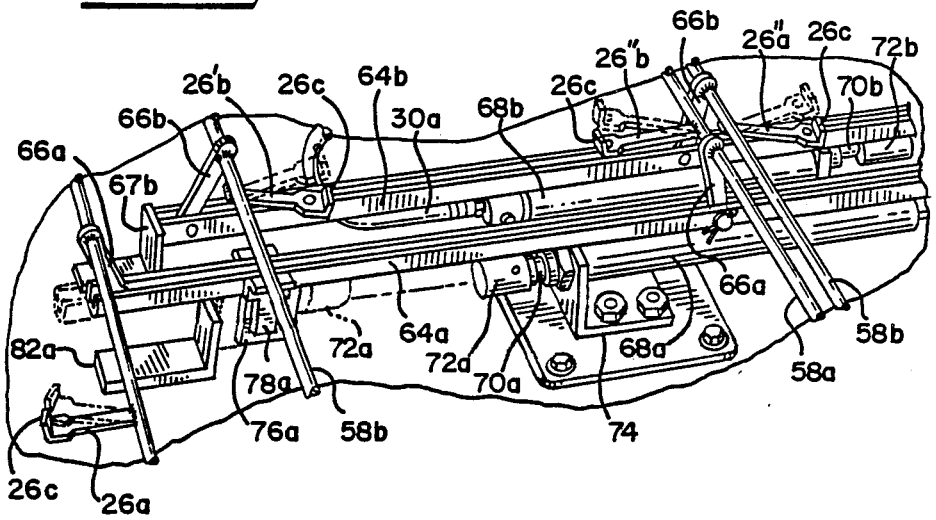
FIG. 4 is an enlarged fragmentary perspective view illustrating the manner in which the paddle control cylinders actuate their corresponding ball propelling paddles.

In accordance with one feature of the invention, the ball propelling paddles 26*a,b*, 26'*a,b* and 26''*a,b* may be caused to undergo relatively rapid rotational ball impacting movement from their lowered positions so that each paddle imparts substantial kinetic energy to the game ball to propel the ball toward the corresponding basket 34*a* or 34*b* in a relatively accurate trajectory. Rotational movement of the ball propelling paddles is effected through identical fluid pressure cylinders 68*a* and 68*b* which, in the illustrated embodiment, comprise single acting pneumatic cylinders having normally retracted piston rods 70*a* and 70*b* supporting impact heads 72*a* and 72*b*, respectively, on their outer ends. The fluid pressure cylinders 68*a* and 68*b* are supported parallel to the base plate 52 by L-shaped support brackets, one of which is shown at 74 in FIGS. 3 and 4, such that each fluid pressure cylinder underlies a corresponding one of the connector bars 64*a,b*. Each of the connector bars 64*a* and 64*b* carries an impact bumper, indicated at 76*a* and 76*b*, respectively, through a corresponding mounting bracket 78*a* and 78*b* such that the impact bumpers are spaced a predetermined distance from the corresponding retracted impact heads 72*a* and 72*b* when the ball propelling paddles 26 are in their lowered or retracted positions. The impact bumpers 76*a,b* are preferably made of a relatively hard resilient material such as rubber, but may alternatively be made of plastic or other suitable material. A pair of L-shaped stop members 82*a* and 82*b* are affixed to the upper surface of the base plate 52 and are spaced, respectively, a predetermined distance from the corresponding impact bumpers 76*a* and 76*b* so as to engage the impact bumpers and limit rotation of the paddle support rods 58*a,b* and corresponding ball propelling paddles 26 when the fluid pressure cylinders 68*a,b* are actuated to extend the impact heads 72*a,b*.

The fluid pressure cylinders 68*a* and 68*b* are controlled, respectively, by the air pump cylinders 28 and 30 through associated air pressure lines or conduits 28*a* and 30*a*. The air pump cylinders 28 and 30, along with air pump cylinders 42 and 44, are supported by housings 12*a* and 12*b* affixed to the sidewalls 48*a* and 48*b*, respectively, of housing 12 so as to expose the upper depressible ends of the pump cylinders. Downward depressing of the upper exposed end of either of the air pump cylinders 28 or 30, as during play, effects extension of the corresponding impact head 72*a* or 72*b* to impact the associated bumper 76*a* or 76*b*. By controlling the rate of depressing the upper ends of the pump cylinders 28 and 30, the players can control the rate of extension of the corresponding piston rods and impact heads 72*a,b* so as to control the impact force imparted to the associated bumpers 76*a,b*, thereby controlling the impact force imparted to the game ball by the corresponding paddle 26. In this manner, each player can control the ball propelling force imparted to the game ball in direct proportion to the downward force applied by the player to his associated air pump cylinder 28 or 30. By spacing the piston impact heads 72*a* and 72*b* from their corresponding bumpers 76*a* and 76*b*, lost motion connections are established between the pressure cylinders 68*a,b* and their associated paddles 26. This enables the impact heads 72*a* and 72*b* to undergo unobstructed accelerated movement as they are initially extended from their corresponding pressure cylinders in response to actuation of the air pump cylinders. Controlled actuation of the air pump cylinders effects predetermined impacting of the impact bumpers 76*a,b* to cause accelerated upward rotation of the associated ball propelling paddles 26 in direct relation to the downward force applied by the player to his pump cylinder, thus giving the player a "feel" of play most conducive to successful shots of the game ball. The rotational momentum imparted to the paddles creates kinetic energy which is imparted to the game ball by the paddle which impacts the game ball, thereby propelling the game ball toward the corresponding target basket 34*a* or 34*b*.

Figure 5:
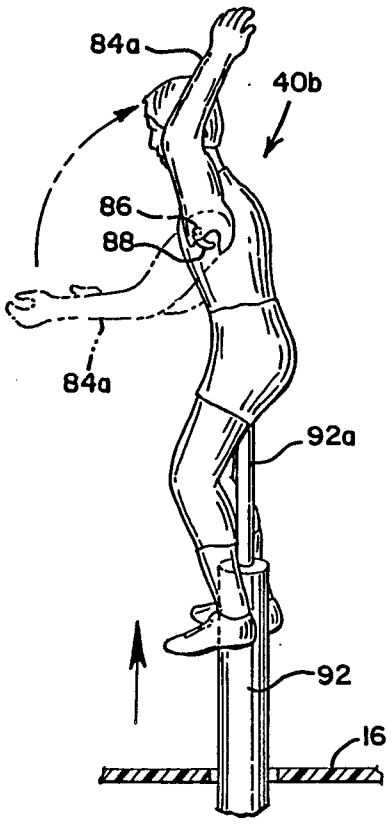
FIG. 5 is a side elevational view of a defensive player-figure having its arms shown in actuated blocking positions in solid lines and in lowered non-actuated positions in phantom.

In addition to controlling selected ones of the ball propelling paddles 26, each player also controls a corresponding one of the defensive player-figures 40*a* and 40*b*. Referring to FIG. 5, taken in conjunction with FIG. 3, the player-figures 40*a* and 40*b* are substantially identical except for desired uniform colors and the like. The player-figures 40*a,b* may be formed of a suitable plastic material and simulate basketball players having pivotal arms 84*a* and 84*b* which may be fixed on opposite ends of a transverse pivot rod or shaft extending through the shoulder area of the player-figure. The arms 84*a,b* are freely pivotal between lowered non-blocking positions, as shown in phantom in FIG. 5, and upward ball-blocking positions wherein the arms extend generally vertically above the players head as shown in solid lines in FIG. 5. Such lower and upward arm positions may be determined by suitable stop means such as stop pins, one of which is indicated at 86 in FIG. 5, fixed to the inner side of each arm and received within an arcuate slot 88 formed in the opposed surface of the body shoulder area. The arms are biased to their lowered positions by gravity.

Movement of the arms 84*a,b* of each player-figure from their lower to their upward ball-blocking positions is effected by causing the player-figures to undergo limited rapid vertical movement such that when the player-figure reaches an upper limit, the upward momentum of the arms pivots them upwardly to their ball-blocking positions. When the arms reach their upper limits, they immediately rebound and descend to their lowered non-blocking positions by gravity. In the illustrated embodiment, rapid vertical movement of the player-figures is effected by actuator means in the form of pneumatic cylinders 92. Each player-figure is mounted on the upper end of a vertically extendable piston rod 92*a* of a corresponding single-acting pneumatic cylinder 92 so that the player-figure's head is approximately 1 inch below the circular rim of the corresponding basket 34*a* or 34*b*. The cylinders 92 are each connected through an associated fluid pressure line 94*a* or 94*b* to a corresponding one of the manually operated air pump cylinders 42 and 44. During play, when a player has caused the game ball 22 to be propelled toward the opponent's basket 34*a* or 34*b* by depressing the player's corresponding air pump cylinder 28 or 30, the opponent player may rapidly depress his corresponding player-figure actuator air pump cylinder 42 or 44 to effect rapid extension of the associated piston rod 92*a* and cause the corresponding player-figure 40*a* or 40*b* to accelerate upwardly. The upward extension or stroke of each piston rod 92*a* is preferably limited to approximately 1½ inches so that when the player-figure reaches its upper limit of travel, the upward momentum of the player-figure's arms 84*a,b* causes them to pivot upwardly to their ball-blocking positions above the player-figure's head and above the corresponding basket 34*a* or 34*b*. As noted, the arms 84*a,b* will begin to descend to their lowered positions almost immediately after reaching their uppermost ball-guarding positions. A suitable bleed orifice is provided in the lower piston head end of each cylinder 92 to allow air pressure to bleed off and effect automatic lowering of the corresponding player-figure after reaching its upper limit. In this manner, a player cannot control the duration of time during which the player-figure or the player-figure's arms remain in raised ball-guarding positions. Thus, it is critical that the player attempting to block his opponent's shot actuate his corresponding player-figure at a relatively precise moment in relation to the opponent player's shot in order to successfully block the shot.

The player-figures 40*a* and 40*b* are capable of limited rotation about the vertical axes of their corresponding pneumatic cylinders 92 so as to exhibit a "live" action during play. Each player-figure 40*a,b* may be positioned and rotatable relative to its corresponding basket 34*a,b* so as to enable blocking of all of the opponents shots, or may be positioned and limited in rotational movement so as to enable blocking of shots from all but the two ball shooting positions on either side of the center hole position in the opponents row of three transversely aligned ball shooting position openings 26'*a* or 26'*b*. The player-figures 40*a,b* may be positioned relative to their corresponding baskets 34*a,b* such that the baskets prevent the player-figures from rotating beyond a rotational angle of approximately 10°–15° on either side of the longitudinal axis of the play surface.

While the illustrated embodiment employs air cylinders and corresponding air pumps to actuate the player-figures, other actuator means, such as solenoid controls or mechanical levers or the like, could be similarly employed to effect selective vertical movement of the player-figures between their non-blocking and ball-blocking positions.

The baskets 34*a* and 34*b* may be made of a suitable plastic to simulate a basketball net, and each preferably has a generally rectangular-shaped cushion member, such as a sponge-like material indicated at 98 in FIG. 2, affixed internally on its rear surface area to prevent an accurate shot of the game ball from rebounding out of the basket. The game ball will thus pass through the basket and return to the play surface.

As briefly described, the ball propelling paddles 26, radial arms 66*a,b* and connector bars 64*a,b* are preferably balanced so that they normally seek positions as illustrated in FIG. 3 through gravitational forces. In this manner, the impact forces applied to the ball propelling paddles by the actuating cylinders 68*a,b* effect immediate upward accelerated rotation of the ball propelling paddles without having to overcome a downward biasing force other than gravity. This leads to an optimum transfer of kinetic energy from the ball propelling paddles to the game ball and results in the game ball traversing an optimum trajectory toward the target basket. As illustrated in FIG. 6, the ball propelling paddles 26 preferably have a reduced width arm portion 26*d* to better concentrate the mass weight of the paddle at its radial outer end. By selective balancing of the system of paddles controlled by each player, the player can actuate the corresponding paddle control air pump 28 or 30 with the same force to achieve accurate shots from his long and short shot ball-shooting positions 18.

Figure 7:
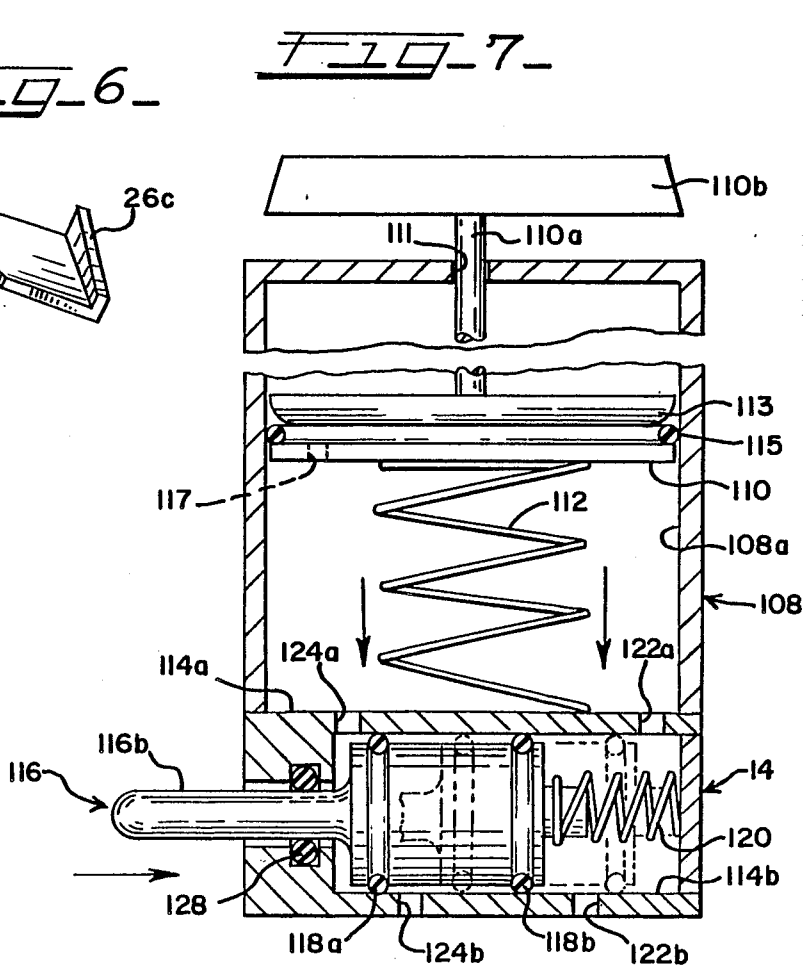
FIG. 7 is a longitudinal sectional view of a hand-held operator control which may be employed in an alternative embodiment of the simulated basketball game in accordance with the invention.

FIG. 7 illustrates an alternative operator control, indicated generally at 106, which may be employed to control the ball propelling paddles 26 and defensive-figures 40*a* and 40*b* in lieu of the aforedescribed pairs of air pump cylinders 28, 42 and 30, 44. A pair of operator controls 106 may be employed in a modified simulated basketball game similar to the basketball game 10 but downsized to a more portable game size through, for example, substantial modification of the housing 12. Each operator control 106 is sized to enable holding in a player's hand, and includes a cylindrical housing 108 having an internal cylindrical air chamber 108*a* which receives a piston 110 having a piston rod 110*a*. The piston rod 110*a* extends through an upper cylindrical opening 111 in housing 108 and has a plunger knob or handle 110*b* which enables manual depressing of the piston 110 against a coil compression spring 112 acting between the piston and a surface 114*a* formed on a housing 114 fixed to the lower end of housing 108. The opening 111 is sized to enable entry and exhaust of air from the rod end of air chamber 108*a* upon actuation of the piston 110. A suitable unidirectional check valve is provided on the piston 110 to enable free upper movement of the piston by spring 112 while preventing escape of air from chamber 108*a* through the piston during a downward compression stroke. In the illustrated embodiment, such a unidirection valve is defined by a rigid circular cup or dish-shaped member 113 which is fixed on rod 110*a* spaced from piston 110, and an 0-ring 115 which is interposed between piston 110 and the covexly-curved peripheral edge surface of member 113. During downward movement of piston 110, the 0-ring acts between the inner surface of chamber 108*a* and member 113 to prevent escape of air. After actuation of piston 110 and release of the handle knob 110*b*, the 0-ring 115 becomes spaced from member 113 to allow passage of air from the rod end to the head end of piston 110 through an orifice 117 in the piston as spring 112 returns the piston to its upper position in chamber 108*a*.

The housing 114 has an internal cylindrical bore 114*b* having a longitudinal axis which preferably transversely intersects the longitudinal axis of chamber 108*a*. A slide or spool valve 116 has a cylindrical body 116*a* which is received within bore 114*b* and carries a pair of axially spaced annular 0-ring seals 118*a* and 118*b* which form pneumatic seals between the outer surface of body 116*a* and the bore 114*b*. The slide valve 116 is slidable within bore 114*b* against a coil compression spring 120 so as to control air flow from chamber 108*a* through respective pairs of ports 122*a,b* and 124*a,b*. An 0-ring seal 128 pneumatically seals an actuating stem end 116*b* of the valve spool 116 within the housing 114.

The port 122*b* of each operator control 106 is connected to one of the ball propelling cylinders 68*a* or 68*b* through a suitable pneumatic flow line (not shown). Similarly, the port 124*b* is connected to the corresponding defensive-player control cylinder 92 so that each player can control selected ones of the ball propelling paddles 26 and the corresponding defensive player-figure. When a player desires to actuate his corresponding ball propelling paddles 26, the player depresses the piston 110 of his control 106 to effect air pressure flow to the associated paddle control cylinder 68*a* or 68*b* through the corresponding outlet port 122*b*. When the player desires to actuate his corresponding defensive player-figure 40*a* or 40*b*, the player depresses the valve spool 116 of his control 106 to block or close valve port 122*a* while simultaneously opening fluid pressure communication between the corresponding ports 124*a* and 124*b*. Depressing piston 110 then admits air pressure to the corresponding player-figure actuating cylinder 92. Release of the valve spool 116 returns it to its extended position again blocking port 124*a* and connecting port 122*a* to port 122*b* to again enable actuation of the corresponding player-figure 40*a* or 40*b*. The paddle control cylinders 68*a* and 68*b* each have a suitable bleed hole in their head ends adjacent the air inlet connection to allow air exhaust and return of the corresponding pistons to their retracted positions when the corresponding control 106 is actuated to operate the defensive player-figure.

Thus, in accordance with the invention, a simulated basketball game is provided which in various embodiments enables two or more players to each control a plurality of game ball propelling paddles in an offensive mode of play, while simultaneously controlling a defensive player-figure to block the opponent's shots. The various paddle actuating components may be balanced to provide optimum transfer of impact energy to the game ball so as to propel it toward a target basket in an accurate trajectory. The defensive player-figures require relatively precise timed actuation to block the opponents shots, thus requiring a challenging degree of skill.

While preferred embodiments of the invention have been illustrated and described, it will be understood that changes and modifications may be made therein without departing from the invention in its broader aspects. Various features of the invention are defined in the following claims.

What is claimed is:

1. A simulated basketball game comprising, in combination;

a play surface having a longitudinal axis and a plurality of openings defining ball shooting positions, a ball propelling shooter member supported beneath each of said ball shooting openings, a basket supported generally adjacent each end of the play surface, first operator means including a plurality of support rods supported generally transverse to the longitudinal axis of the play surface proximate selected ones of said ball shooting openings, each of said support rods supporting corresponding ones of said ball propelling shooter members and operative by a first player through first fluid pressure means to propel a ball disposed within a corresponding ball shooting position toward a selected one of said baskets in an offensive mode of play, second operator means including a plurality of support rods supported generally transverse to the longitudinal axis of the play surface and supporting the remainder of said ball propelling shooter members and operative by a second player through second fluid pressure means to propel a ball disposed within a corresponding ball shooting position toward the other of said baskets in an offensive mode of play, a defensive player-figure supported generally adjacent each of said baskets and movable between a first non-blocking position and a second ball-blocking position, and first and second control means each cooperative with a selected one of said player-figures and operative by a selected one of said first and second players to move the corresponding player-figure between its said first and second positions in a defensive mode of play, said first and second fluid pressure means being operative to impart kinetic energy to a game ball when disposed within a corresponding ball shooting position.

2. A basketball game as defined in claim 1 including housing means supporting said play surface and said operator and control means in a manner to enable two players to play the game when standing on opposite sides of said housing.

3. A basketball game as defined in claim 2 wherein said housing means includes upstanding end walls adapted to support a dome for preventing escape of a game ball from the general area of the play surface.

4. A basketball game as defined in claim 1 wherein said play surface is defined by a contoured surface defining surface areas adjacent each of said openings configured to cause a spherical game ball disposed on one of said surface areas to roll by gravity to the corresponding opening.

5. A basketball game as defined in claim 4 wherein said contoured surface areas are contiguous so that substantially the full surface area of said play surface is contoured.

6. A basketball game as defined in claim 1 including a spherical game ball, said openings being circular and each having a diameter less than the diameter of said game ball.

7. A basketball game as defined in claim 1 wherein each of said shooter members comprises a ball propelling paddle supported generally radially on a transverse support rod beneath the corresponding ball shooting opening, each of said first and second fluid pressure means includes a fluid pressure cylinder operatively interconnected to selected ones of the support rods in a manner to effect generally simultaneous rotational movement of the corresponding ball propelling paddles upon actuation of the fluid pressure cylinders so as to impart kinetic energy to a game ball when disposed within a corresponding ball shooting position.

8. A basketball game as defined in claim 7 including housing means supporting said play surface in a generally horizontal orientation, said support rods being supported by said housing means to underlie said play surface, said fluid pressure cylinders each being operatively interconnected to the corresponding support rods through radial pivot arms such that actuation of each fluid pressure cylinder effects equal rotational movement of the associated ball propelling paddles.

9. A basketball game as defined in claim 7 wherein said first and second operator means each further includes an air pump operatively interconnected to the corresponding fluid pressure cylinder, each of said air pumps being operative by one of said first and second players to actuate the corresponding ball propelling paddles.

10. A simulated basketball game comprising, in combination;

a play surface having a plurality of openings defining ball shooting positions, a ball shooting member supported beneath each of said ball shooting openings, a basket supported generally adjacent each end of the play surface, first operator means cooperative with selected ones of said ball shooting members and operative by a first player to propel a ball disposed within a corresponding ball shooting position toward one of said baskets in an offensive mode of play, second operator means cooperative with the remainder of said ball shooting members and operative by a second play to propel a ball disposed within a corresponding ball shooting position toward the other of said baskets in an offensive mode of play, a defensive player-figure supported generally adjacent each of said baskets and movable between a first non-blocking position and a second ball-blocking position, and first and second control means each cooperative with a selected one of said player-figures and operative by a selected one of said first and second players to move the corresponding player-figure between its said first and second positions in a defensive mode of play, each of said defensive player-figures having a pair of arms freely pivotally movable between lowered and raised positions, said first and second control means each including actuator means operative to effect limited upward movement of a corresponding one of said defensive player-figures, the arms of each of said player-figures being caused to pivot upwardly to ball-blocking positions by momentum energy when the corresponding player-figure reaches its upper limit of movement, and being biased to said non-blocking positions by gravity.

11. A basket ball game as defined in claim 10 wherein each of said actuator means includes a fluid pressure cylinder operatively associated with the corresponding player-figure, and a fluid pressure pump operatively connected to each of said pressure cylinders so as to enable each player to selectively actuate the corresponding player-figure between its first and second positions.

12. A basketball game as defined in claim 10 wherein said actuator means is incapable of maintaining said arms in said ball-blocking positions.

13. A basketball game as defined in claim 1 wherein each of said ball propelling members comprises a ball propelling paddle having a ball impacting end configured to impact a game ball when disposed within the corresponding opening so that the game ball traverses a trajectory toward its target basket.

14. A basketball game as defined in claim 7 wherein each of said fluid pressure cylinders comprises a single-acting air cylinder.

15. A basketball game as defined in claim 1 wherein said first operator means and said first control means are operable through a unitary operator control adapted to be controlled by one of the players, said second operator means and said second control means being operable through a second unitary operator control adapted to be controlled by the other player such that selective control of each unitary operator control effects selective control of the corresponding ball propelling members and defensive player-figure.

16. A basketball game as defined in claim 15 wherein said unitary operator controls are modular and adapted to be supported within a player's hand.

17. A basketball game as defined in claim 16 wherein each of said unitary operator controls includes means enabling operation in a first mode to actuate the corresponding ball propelling members, and operation in a second mode to actuate the corresponding player-figure between its first and second positions.

18. A basketball game as defined in claim 7 wherein said ball propelling paddles and associated support rods are selectively interconnected through associated connecting bars each having an impact member carried thereon, each of said first and second operator means further including fluid pressure means adapted to impact the corresponding impact member so as to effect accelerated rotational movement of the corresponding ball propelling paddles upon actuation of the fluid pressure means.

19. A basketball game as defined in claim 7 wherein said radial ball propelling paddles are of increasing radial length in relation to their distance from a corresponding target basket.

20. A simulated basketball game comprising, in combination:

a play surface having a plurality of openings defining ball shooting positions and being surrounded by a surface area configured to cause a game ball disposed thereon to migrate by gravity to the associated opening, a ball propelling paddle supported below each of said ball shooting openings, a basket supported generally adjacent each of the opposite ends of the play surface and spaced thereabove, first operator means associated with said paddles such that selected ones of said paddles may be controlled by each of two players, a simulated defensive player-figure supported adjacent each of said baskets and being operative between a first non-blocking and a second ball-blocking position, and control means associated with said player-figures such that each of the two players may selectively control a defensive player-figure between its first and second positions, whereby each player may actuate selected ones of the ball propelling paddles and a defensive player-figure in offensive and defensive modes of play, said defensive player-figures having freely pivotal arms thereon biased by gravity to said first non-blocking positions, said control means being selectively operative to effect limited substantially vertical upward movement of the corresponding player-figure so as to cause its arms to pivot upwardly solely by momentous energy to said ball-blocking positions against the forces of gravity.

21. A basketball game as defined in claim 20 wherein said first operator means includes a pair of fluid pressure cylinders, and lost motion means operative between each of said cylinders and selected ones of said paddles so as to effect impact movement of said paddles to ball propelling positions upon actuating the corresponding fluid pressure cylinder.

* * * * *